United States Patent [19]

Packham

[11] 4,292,737

[45] Oct. 6, 1981

[54] DRY SHAVER WITH DIFFERENTIALLY BIASED INNER CUTTER AND BASE MEMBERS

[75] Inventor: Charles C. Packham, Berkshire, England

[73] Assignee: The Gillette Company, Boston, Mass.

[21] Appl. No.: 99,247

[22] Filed: Dec. 3, 1979

[30] Foreign Application Priority Data

Dec. 11, 1978 [GB] United Kingdom ..... 48009/78

[51] Int. Cl.[3] ..... B26B 19/06

[52] U.S. Cl. ..... 30/43.92

[58] Field of Search ..... 30/43.5, 43.8, 43.91, 30/43.92, 346.51

[56] References Cited

U.S. PATENT DOCUMENTS

| | | | |
|---|---|---|---|
| 2,694,251 | 11/1954 | Tissot-Dupont | 30/43.92 X |
| 3,178,818 | 4/1965 | Liska | 30/43.92 X |
| 3,343,259 | 9/1967 | Brodie | 30/43.92 |
| 3,376,636 | 4/1968 | Schuessler | 30/43.92 |
| 3,423,826 | 1/1969 | Liska | 30/43.92 |

FOREIGN PATENT DOCUMENTS

| | | | |
|---|---|---|---|
| 1069500 | 11/1959 | Fed. Rep. of Germany . | |
| 1117443 | 11/1961 | Fed. Rep. of Germany . | |
| 1199777 | 6/1959 | France | 30/346.51 |
| 54-23366 | 9/1979 | Japan | 30/43.5 |
| 628599 | 9/1949 | United Kingdom | 30/43.92 |
| 1036915 | 7/1966 | United Kingdom . | |
| 1171322 | 11/1969 | United Kingdom . | |
| 503715 | 3/1976 | U.S.S.R. | 30/43.5 |

*Primary Examiner*—Gary L. Smith

*Attorney, Agent, or Firm*—Raymond J. De Vellis

[57] ABSTRACT

A dry shaver has a reciprocating inner cutter (9) cooperating with an arched flexible foil (8) of which the foil is fastened at its edges to a base member (7) and the inner cutter is pressed against the foil by springs which act between the inner cutter and the base member. The above mentioned parts form a cutting unit which is detachably mounted on the casing through the intermediary of spring loaded retainers (18) which permit movement of the cutting unit towards and away from the casing. The resilient force applied through the retainer is substantially less than that of the springs acting on the inner cutter, so as to permit displacement of the cutting unit under the forces encountered during shaving without deflection of the inner cutter springs.

8 Claims, 5 Drawing Figures

DRY SHAVER WITH DIFFERENTIALLY BIASED INNER CUTTER AND BASE MEMBERS

This invention relates to dry shavers of the type in which the cutter assembly comprises a reciprocating inner cutter co-operating with a flexible arched foil, against which the inner cutter is pressed by spring means in order to maintain the foil in a suitably stressed condition, and provided the foil is not subjected to excessive pressure during shaving, it maintains its normal arched configuration and its intimate contact with the inner cutter.

However, if sufficient pressure is applied by the user, the foil deforms locally, displacing the inner cutter inwardly against its spring bias, so that the inner cutter loses contact with the foil over some part or parts of its length. This in turn reduces the efficiency of the shaving head close to the locality of deformation, so that long hairs passing through the foil in that region can be engaged by the inner cutter and pulled without being cut cleanly. Even if the cutter does not pull the hairs in this way, the apertures in the foil can catch and pull the hairs, with resultant discomfort.

The primary object of the present invention is to obviate or reduce this disadvantage.

The invention accordingly provides a dry shaver including a casing on which is carried a cutter assembly comprising a reciprocating inner cutter co-operating with a flexible arched foil against which the inner cutter is pressed by spring means, wherein the foil and inner cutter are mounted on a common base member, the foil being attached along its longitudinal edges to the base member, and the said spring means acting between the base member and inner cutter, and wherein the base member is mounted on the casing for movement towards and away from the casing in directions transverse to the direction of reciprocation of the inner cutter and is urged away from the casing by resilient means whose spring force is less than that of the said spring means.

With this arrangement, the foil, inner cutter base member and spring means form a self-contained cutting unit which is resiliently movable as a whole relative to the body, and the resilient means may exert a very small spring force so that the unit has a light floating action which enables the unit to deflect easily under pressure encountered during shaving. The unit is preferably so mounted and spring loaded as to permit of its rocking about a transverse axis, so that the unit conforms readily to the general contours of the skin during shaving.

The cutting unit is conveniently mounted on the casing in a readily detachable manner to facilitate cleaning of the head.

Reciprocating motion is preferably transmitted to the inner cutter by a drive pin which is perpendicular to the longitudinal axis of the cutting unit and engages in a tubular socket fast with the inner cutter, the socket and peg being axially movable, relative to each other to accommodate movement of the cutting unit relative to the casing.

In a presently preferred form of the invention a dry shaver is provided with two cutting units, each of the form described above and movable, relative to the casing, independently of each other. This arrangement permits a high degree of conformance of the cutting units to the facial contours. When two (or more) cutting units are provided, they may be of identical form or may differ from each other in such particulars as, for example, their radius in the operative regions of foil and inner cutter, the perforation pattern of the foil, the spring forces acting between the inner cutter and foil and the spring force acting between the casing and the cutting unit.

One form of dry shaver in accordance with the invention will now be described, by way of example, with reference to the accompanying drawings, in which.

Figure 1:
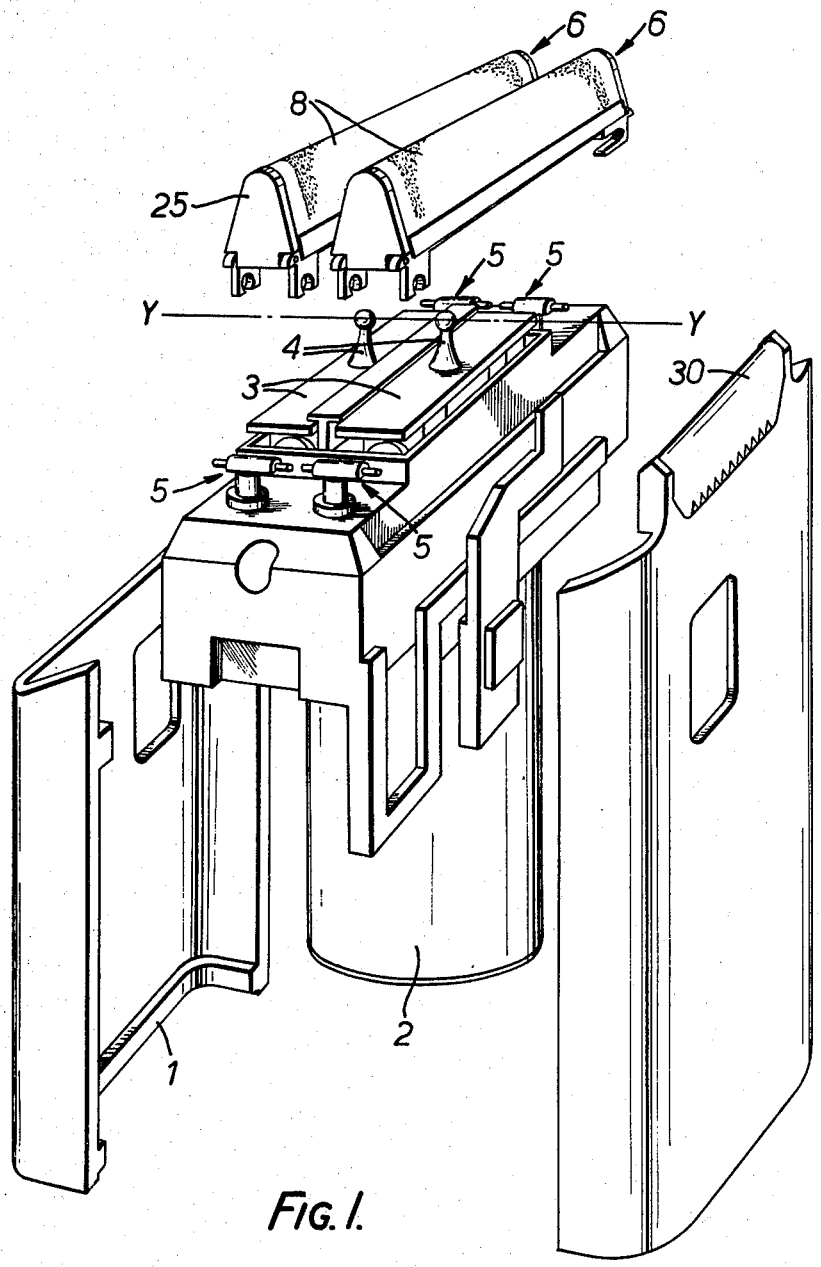
FIG. 1 is an exploded perspective view of the dry shaver, some parts being omitted for clarity.

The dry shaver comprises a casing 1 formed as two half casings supporting and substantially enclosing a chassis 2 which houses an electric motor which may be driven in known manner from a mains supply, dry cell batteries or a rechargeable battery (not shown). Projecting from the upper part of the chassis are two reciprocating drive members in the form of drive plates 3 having upstanding drive pegs 4, and four spring loaded retainers 5.

Figure 2:
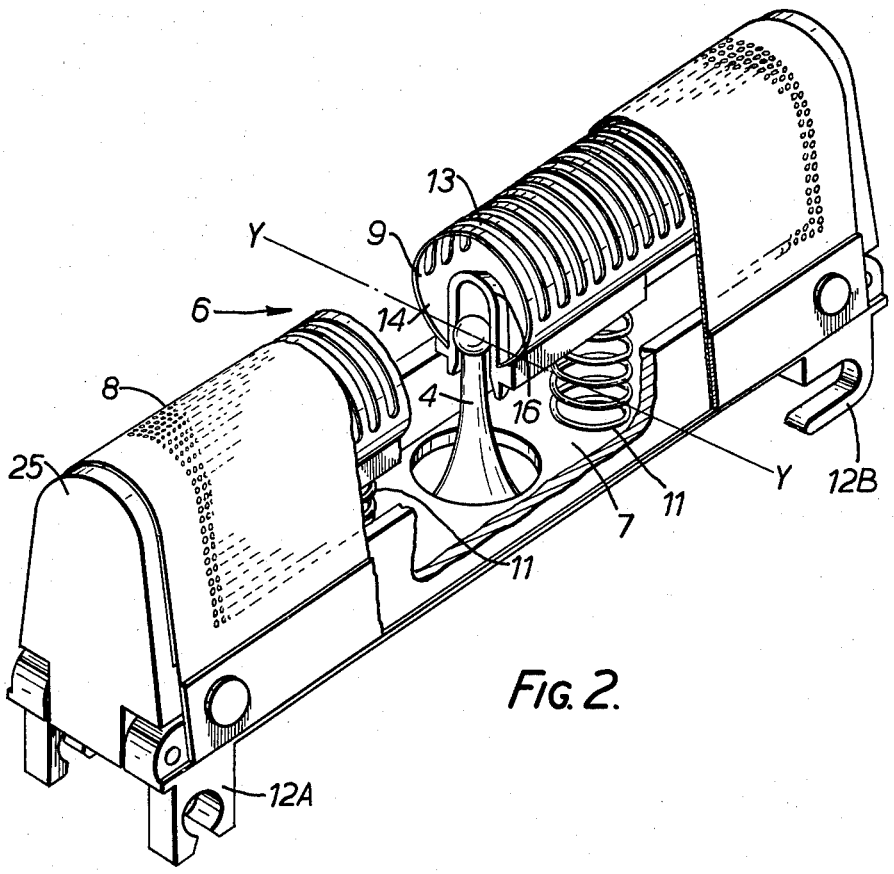
FIG. 2 is an enlarged partially sectioned perspective view of part of the dry shaver.

Two cutting units 6 are detachably mounted on the retainers 5, each unit comprising a base member in the form of a plate 7, an arched foil 8, an inner cutter 9 and a pair of coil compression springs 11 (seen in FIG. 2). The base plate 7 is of generally rectangular form and has at each end a pair of depending lugs 12A,12B for co-operation with respective retainers 5, one pair of lugs 12B having elongate slots to facilitate assembly with the retainer. The flexible, perforated foil 8 is held in arched condition by having its longitudinal edges secured e.g. rivetted to the corresponding edges of the base plate 7. The inner cutter 9 is of thin-walled cylindrical form having a transversely slotted cutting section 13 and a solid lower section 14 which is apertured at its centre to receive a tubular socket 16 which in turn receives the part-spherical upper end of the respective drive peg 4, which extends upwardly through an enlarged hole 17 in the base plate 7.

The coil compression springs 11 are mounted to act between the base plate 7 and the underside of the inner cutter 9, urging the latter into co-operating sliding engagement with the inner surface of the foil 8.

Figure 3:
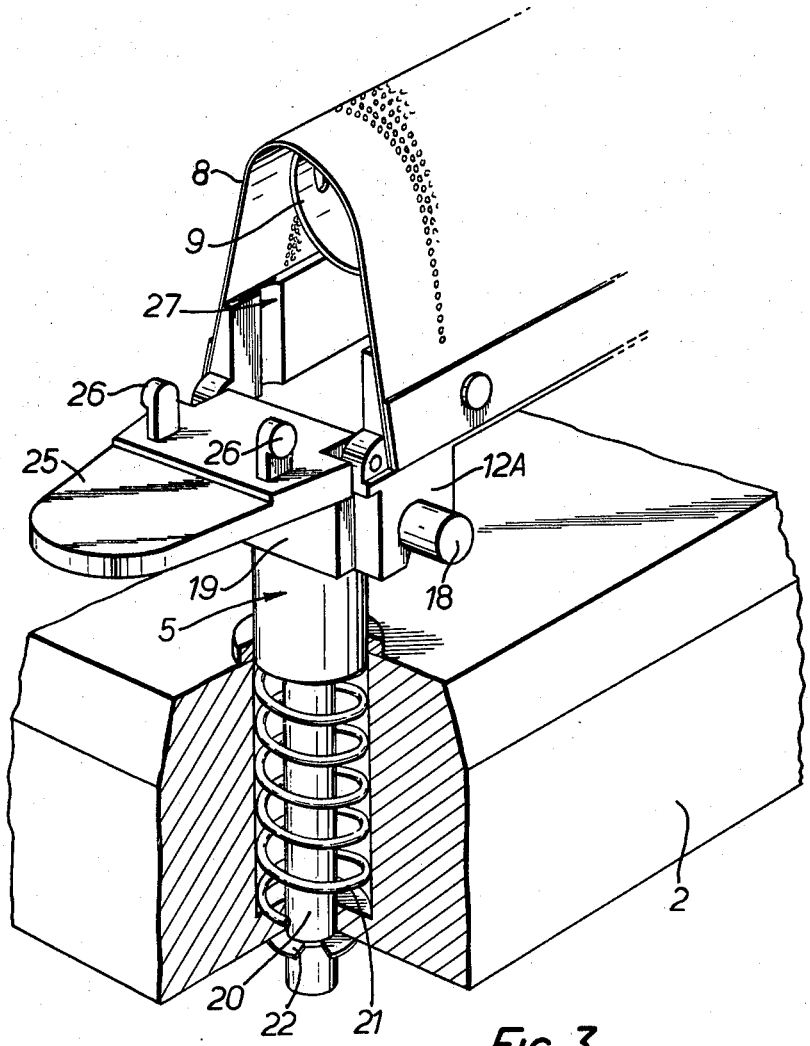
FIG. 3 is an enlarged, partially sectioned view of another part of the dry shaver.

As shown in FIG. 3, the lugs 12A at one end of the plate 7 make snap-fitting engagement over respective laterally projecting pins 18 formed on the head 19 of an adjacent retainer 5. The slotted lugs 12B at the other end of the plate 7 are simply hooked over the corresponding pins 18, the pins and lugs making the plate 7 fast with, but detachable from the casing. The head 19 of each retainer has a depending stem 20 guided for axial movement in the chassis and urged outwardly by a light coil spring 21, this movement being limited by a stop 22 at the lower end of the stem.

Thus it will be seen that the cutting units are each mounted on the chassis and casing in a manner which permits them to move inwardly against the restoring forces of resilient means constituted by the springs 21, each unit being movable bodily towards and away from the casing, and rockably about a transverse axis indicated at YY in FIGS. 1 and 2.

The outwardly directed forces exerted by the springs 21 are substantially smaller than those exerted by the cutter springs 11, so that in use, shaving pressure exerted on the foil can easily displace the units inwardly of the casing, without causing any deflection of the cutter springs 11, thus ensuring that the foils can maintain full and proper contact with the inner cutters.

By way of example, the spring force applied to the inner cutter may be 300 grams while the force applied by each of springs 21 is typically 50 to 75 grams.

Movement of each cutting unit as a whole, relative to the casing, without interference with the driving connection between the motor and the inner cutter is accommodated by co-operation of the drive pins 4 with the tubular sockets 16. The sockets have sufficient axial extent to permit sliding movement of the sockets relative to the drive pins, whose part-spherical heads maintain substantially annular line contact with the sockets. This line contact is maintained when the inner cutter rocks about its transverse axis, relative to the drive pin.

It will be understood that the springs 11 flex laterally to permit reciprocation of the inner cutters relative to the foils.

The fact that both cutting units are free to move independently in the manner described above, with little spring restraint, permits them to conform readily to facial contours during shaving, but without the risk of the foils being locally deformed in normal use of the shaver. Inward movement of the cutter units is, of course, limited but the user will usually be aware of the relatively free movement being taken up. The free movement permitted may be, for example about 3 mm.

The cutting units can be detached to facilitate cleaning by pulling them off their retainers. The units are particularly easy to clean by virtue of the fact that the inner cutters form open ended tunnels which are virtually uninterrupted except for the sockets 16, and hair clippings and dust can accordingly be readily ejected by blowing through the inner cutters.

Preferably and as illustrated in FIGS. 1 to 4, the open ends of the arched foils are normally closed by end cheeks 25 which are pivotally mounted on the ends of each base plate 12. The cheeks are moulded with integral lugs 26 which make releasable, snap fitting interengagement with recesses 27 formed on the base plate when the cheeks are in the closed position shown in FIGS. 1 and 2. They are, however, readily snapped open as shown in FIG. 3 to expose the ends of the arched foil and of the inner cutter to facilitate the removal of debris.

Figure 4:
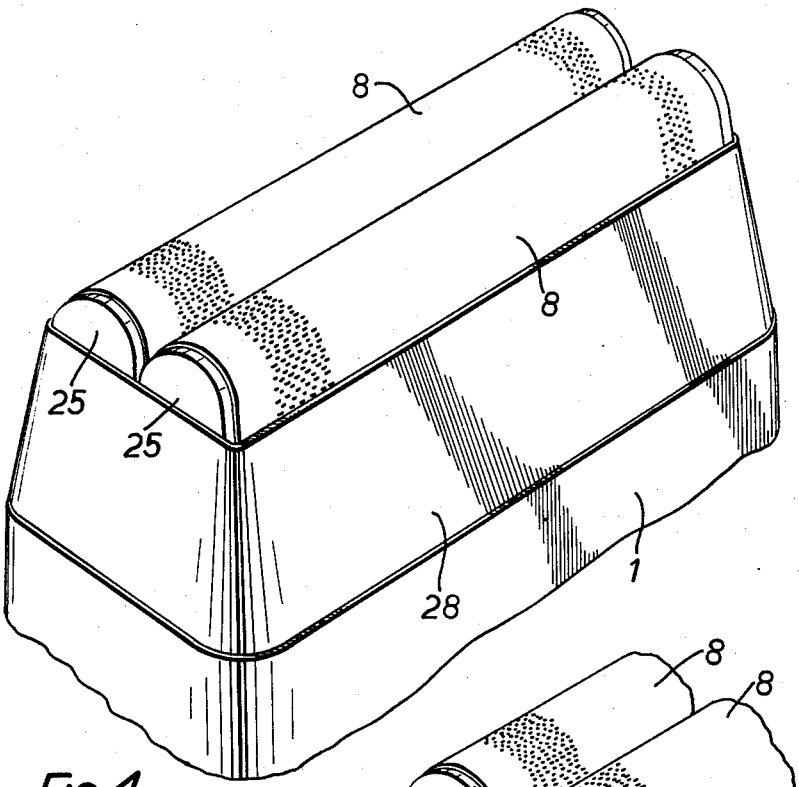
FIG. 4 is a perspective view of part of the complete shaver.
Figure 5:
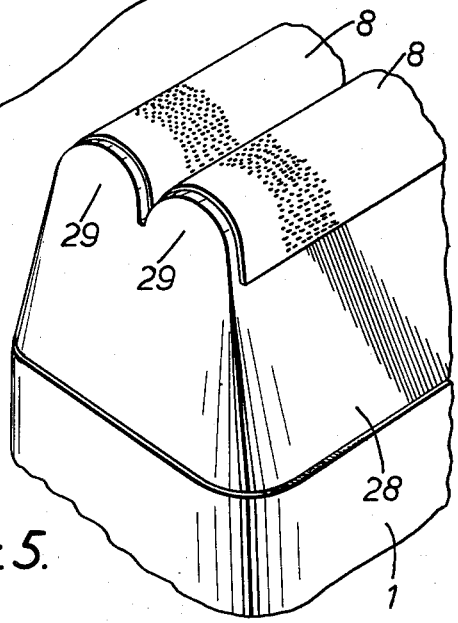
FIG. 5 is a view like FIG. 4 illustrating a modification.

As shown in FIG. 4, the shaver is provided with a snap fitting, removable cowl 28 to conceal and protect the lower portion of the cutter units and the main drive connections.

The above described end cheeks can be omitted if desired, but in that case we prefer to modify the cowl, as shown in FIG. 1 by the addition of arched projections 29 which cover the arched ends of the foils in the outermost position of the cutter units.

Provisions may be made, if desired, for adjusting the pre-stresses of the retainer springs 21 independently of each other. It would then be possible, for example, to stress one unit more than the other to suit an individual users personal preference.

According to another possible modification, not shown, the pair of cutter springs 11 may be replaced by a single spring positioned at the centre of the base plate 7 and inner cutter 9, surrounding with clearance the drive pin 4. In this case the spring is preferably of spiral form, tapering towards its connection to the inner cutter. Furthermore, the inner cutter can take forms other than that illustrated. It may, for example be of part circular form, with the lower portion substantially flat. The cylindrical form illustrated is, however, presently preferred because of the ease with which it can be manufactured to a high degree of accuracy.

The drive mechanism as such forms no part of the present invention but is preferably arranged to operate the two inner cutters 180° out of phase in order to reduce out of balance cyclical forces on the shaver.

The shaver may conveniently incorporate a trimmer for cutting long hair. A trimmer guard is shown at 30 in FIG. 1 and the associated cutter is coupled in any convenient manner to the drive mechanism.

I claim:

1. A dry shaver having a drive means for providing reciprocating motion and including a casing on which is carried a cutter assembly comprising a reciprocating inner cutter driven by said drive means, said inner cutter co-operating with a flexible, arched foil against which said inner cutter is pressed by spring means, wherein said foil and said inner cutter are mounted on a common base member, said foil being attached along its longitudinal edges to said base member, said spring means acting between said base member and said inner cutter, wherein said base member is mounted on said casing for movement toward and away from said casing in directions tranverse to the direction of reciprocation of said inner cutter, and said base member is urged away from said casing by resilient means whose spring force is less than that of the said spring means said resilient means being independent of said spring means and said drive means.

2. A dry shaver according to claim 1, wherein said cutter assembly, said base member and said spring means form a self contained unit detachable as a whole from said casing.

3. A dry shaver according to claim 1 or 2, wherein said casing carries retainer members on which said base member is mounted, said retainer members being displaceable relative to said casing independently of each other in a direction transverse to the length of said inner cutter and wherein said resilient means act on said retainer members to urge said retainer members outwardly of said casing.

4. A dry shaver according to claim 3 wherein said base member, said foil and said inner cutter are mounted on said casing for rocking motion in unison about a transverse axis.

5. A dry shaver according to claim 4, wherein said drive means includes a motor driven drive pin engaged in a tubular socket fast with said inner cutter at the centre thereof, said drive pin being transverse to the longitudinal axis of said inner cutter, said pin and said socket co-operating to permit displacement of said inner cutter toward and away from said casing and the rocking motion of said inner cutter relative to said casing said drive pin.

6. A dry shaver according to claim 5 comprising two or more said cutter assemblies, each associated with a respective base member, and movable, relative to said casing, independently of each other and against the action of respective said resilient means.

7. A dry shaver according to claim 6 in which the ends of each said foil are normally closed by end cheeks which are mounted on said base member for movement between their normal closed positions and open positions in which said ends of said foil and said inner cutter are exposed for cleaning.

8. A dry shaver comprising a casing which houses a drive motor operatively connected to a drive pin which is driven in linear reciprocation along an axis by said motor and which projects from said casing at one end thereof, a pair of retainer members mounted on said casing at said one end thereof and spaced apart along said axis to either side of said drive pin, said retainer members being displaceable towards and away from said casing independently of each other in direction perpendicular to the axis, resilient means acting on said retainer members to urge them outwardly of said casing, a shaving head base member of elongate form detachably secured at its respective ends to said retainer members so as to be movable, relative to said casing both in translation toward and away from said casing and for rocking motion about a transverse axis, a flexible arched foil secured along its longitudinal edges to said base member, an inner cutter disposed adjacent the internal, concave surface of said foil, spring means acting between said base member and said inner cutter to urge the latter outwardly into sliding engagement with said foil, said spring means exerting a greater spring force on the inner cutter than said resilient means exert on said base member, and a releasable driving connection between said drive pin and said inner cutter.

* * * * *